US005669432A

United States Patent [19]

Nisenson et al.

[11] Patent Number: 5,669,432

[45] Date of Patent: Sep. 23, 1997

[54] AUTOMATIC-LOCKING MECHANICAL DRIVE CONSTRUCTION

[76] Inventors: Jules Nisenson, 36 Treetop La., Poughkeepsie, N.Y. 12603; Ronald E. Bischoff, 19 Central Ave., Wappingers Falls, N.Y. 12590

[21] Appl. No.: 623,416

[22] Filed: Mar. 28, 1996

[51] Int. Cl.[6] ..... E06B 9/56

[52] U.S. Cl. ..... 160/307; 160/321

[58] Field of Search ..... 160/307, 308, 160/313, 318, 319, 321, 323.1, 298; 192/8 C, 17 D, 41 S, 81 C

[56] References Cited

U.S. PATENT DOCUMENTS

| | | | |
|---|---|---|---|
| 4,372,432 | 2/1983 | Waine et al. | 160/307 X |
| 4,779,662 | 10/1988 | Wilk | 160/321 |
| 4,865,109 | 9/1989 | Sherman | 160/321 |
| 5,009,259 | 4/1991 | Miloslaus | 160/323.1 |
| 5,375,643 | 12/1994 | Rude | 160/321 |
| 5,482,105 | 1/1996 | Rude | 160/307 |
| 5,542,464 | 8/1996 | Shiina | 160/321 X |

*Primary Examiner*—David M. Purol

[57] ABSTRACT

An automatic-locking mechanical drive construction for raising and lowering a window covering, including a fixed cylindrical shaft, a rotary drive member mounted to rotate about an axis with respect to the shaft, and a rotary driven member turnable with respect to the shaft and about the axis of the drive member. The drive and driven members have pairs of facing, abuttable walls effecting a two-directional, lost-motion rotary driving connection between the members, and a helical coil spring is disposed on the shaft, so as to frictionally seize it, and selectively lock thereon. The spring has a radially-projecting shoulder intermediate its ends. Spaced-apart shoulders on the driven member are individually engageable with the projecting shoulder on the spring whereby the spring normally prevents turning of the driven member in either of opposite directions. Lugs on the driving member respectively engage end portions of the spring to unlock its grip on the shaft, thereby enabling the abuttable walls of the driven and drive members to turnably drive the driven member in either of two directions as the drive member is turned in either of opposite directions.

20 Claims, 5 Drawing Sheets

FIG. 7
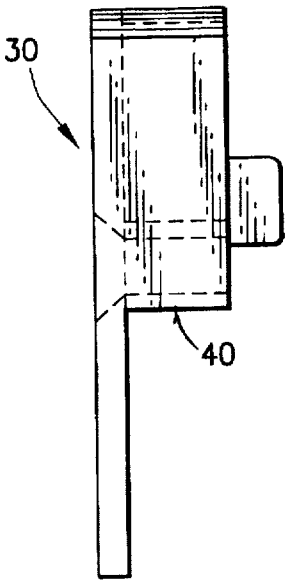
FIG. 8
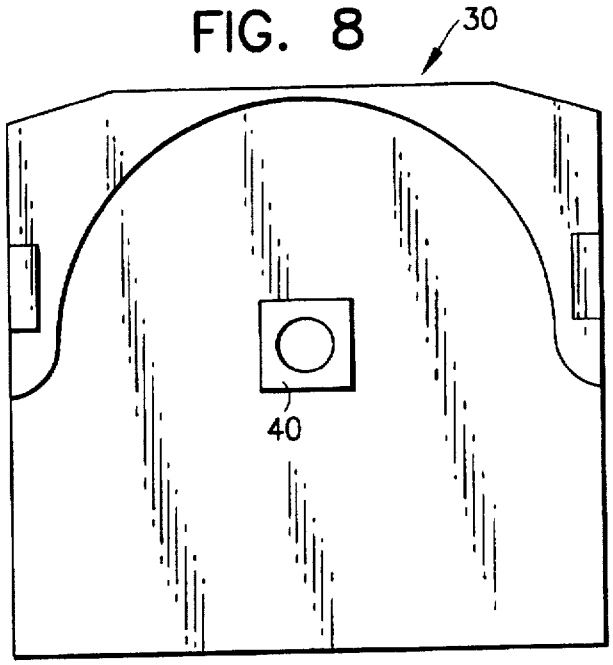
FIG. 10
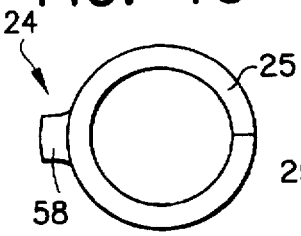
FIG. 9
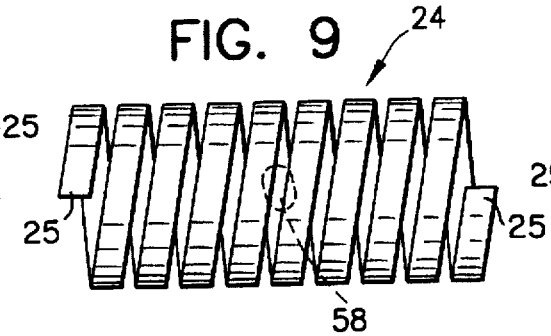
FIG. 11
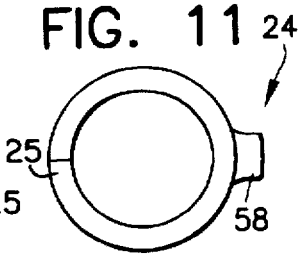
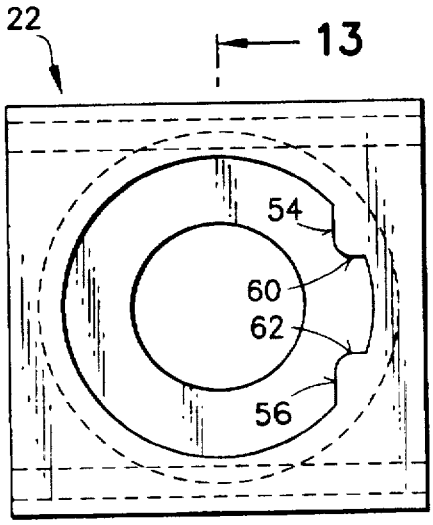
FIG. 12
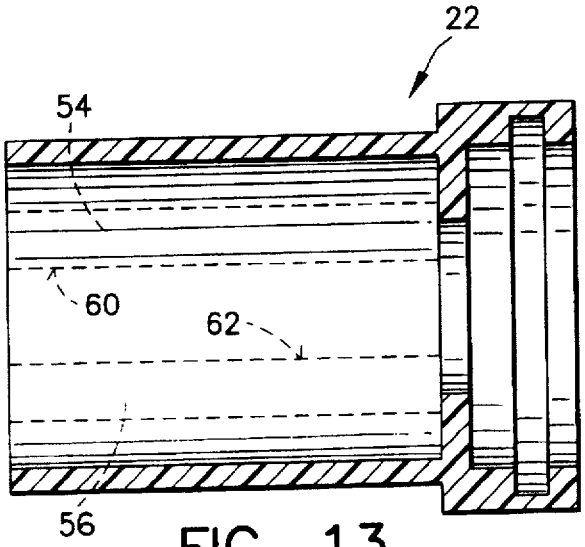
FIG. 13
13

AUTOMATIC-LOCKING MECHANICAL DRIVE CONSTRUCTION

NO CROSS REFERENCES TO RELATED APPLICATIONS

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

FIELD OF THE INVENTION

This invention relates generally to spring clutch mechanisms especially adapted for use with window shades and/or coverings, and more particularly to improvements in clutch devices of the "unwrap spring" type, wherein the friction between a spring that is carried on a core member is varied so as to selectively bind or else release a driven member for turning movement with respect to the core member.

More particularly, the invention relates to improvements in the constructions illustrated and described in U.S. Pat. No. 4,372,432, issued Feb. 8, 1983, and granted jointly to two co-inventors, one of whom is a co-inventor of the subject matter of the present patent application.

DESCRIPTION OF THE RELATED ART INCLUDING INFORMATION DISCLOSED UNDER 37 CFR Sections 1.97–1.99

In addition to U.S. Pat. No. 4,372,432 noted above, the following references are hereby made of record, as being of interest in the technical field of the invention:

U.S. Pat. Nos.:

| | | |
|---|---|---|
| Re 16,565 | 823,971 | 1,783,002 |
| 2,145,666 | 3,135,369 | 3,307,663 |
| 3,340,975 | 3,477,486 | 3,915,268 |
| 4,433,765 | 4,751,953 | 4,779,662 |
| 5,058,720 | 5,167,269 | 5,375,643 |

Referring first to U.S. Pat. No. 4,372,432, there is disclosed a clutch mechanism adapted for window shades. The embodiment of FIGS. 10 and 11 is of interest in that it shows the general concept of utilizing a stationary core (34) upon which is wound a spring (48), such that the latter normally hugs, or binds against the surface of the core (34). The mechanism includes a drive member in the form of a sprocket wheel (66) having a projecting rib (132) that fits between radially-extending end tangs of the spring, as in FIG. 11; the driven member (98) is arranged to carry the window shade per se, and has a cutout or U-shaped channel (138). In operation, the weight of the shade tends to urge either one of the spring tangs in a "wrapping-on" direction with respect to the core, thus giving rise to binding of the spring thereon, which in turn prevents movement of the driven member (98). On the other hand, turning of the sprocket wheel (66) causes the rib (132) to engage one tang or the other, and in an "unwrapping" direction wherein the spring's grip on the stationary core (34) is loosened to the extent that continued turning of the sprocket wheel eventually causes driving engagement of the rib with one of the edges of the cutout (138), resulting in turning of the driven member (98). In any case, when the sprocket is no longer manually turned, the release-type force of the rib (132) on the spring no longer exists, causing the spring to return to its normal gripping engagement with the stationary core, and thus halting movement of the driven member (98).

A similar arrangement is shown in U.S. Pat. No. Re 16,565, which discloses a clutch utilizing a drive member, a driven member, a stationary core, and an unwrap spring which is selectively frictionally engaged with the core to control movement of the driven member in response to force applied to the spring by a drive member. In the disclosed construction, the spring is wound so as to elastically grip the surface of the core member (2), which is stationary.

Considering the remaining references chronogically, U.S. Pat. No. 823,971 relates to a mechanical clutch which comprises a drive member, a driven member, a stationary core or drum, and a control spring. The operation is briefly described on page 2 of the specification, beginning at line 39, referring to FIGS. 2–4.

U.S. Pat. No. 1,783,002 discloses a shade mechanism incorporating a clutch having a control spring, and a separate, counterbalancing spring which tends to oppose the force of the weight of the shade. The shade can be manually drawn against the restoring force of the counterbalancing spring, since such movement is in a direction which causes the control spring to loosen on a stationary clutch drum. Upon release of the drawing force from the shade, the control spring tightens to thereafter hold the shade in place. Raising of the shade is initiated via a pull cord, which latter momentarily exerts an unwrapping torque on the control spring and allows the counterbalance spring to wind up the shade. Release of the cord restores the frictional engagement of the control spring with its stationary drum, halting the upward movement of the shade at a location corresponding to the release of the cord.

U.S. Pat. No. 2,145,666 illustrates a modified construction, wherein a coil spring is arranged to selectively engage the inner cylindrical surface of a stationary clutch casing, in order to provide the desired control between a drive member and driven member. The operation is briefly described on page 2, beginning at col. 1, line 75 of the specification.

Yet another window shade operator is disclosed in co-applicant's U.S. Pat. No. 3,135,369, which utilizes a drive member, a driven member, a stationary core, and a control spring which seizes upon the core in the event of torque being applied to the driven member, and which releases from the core upon the drive member being turned, the latter in turn effecting corresponding movement of the driven member.

A modification of the spring clutch concept is shown in U.S. Pat. No. 3,307,663, in which the spring control member has been replaced by a spring band, in effect, constituting a single turn or single-convolution spring. The particular application for the device is not given in the patent specification.

Further modifications of the unwrap spring concept are illustrated in U.S. Pat. Nos. 3,340,975 and 3,477,486; the earlier of the two shows a spring coupling between two aligned shafts, and wherein the frictional engagement of the spring with the shaft surfaces is controlled by an electric solenoid that is selectively energizeable. Operation of the solenoid results in displacement of the spring ends in such a direction as to unwind the spring, and thereby release the frictional engagement of the aligned shafts with the spring. U.S. Pat. No. 3,477,486 shows a screwdriver incorporating an unwrap spring as a clutch element, providing a single-direction drive function to the tool, in the nature of a ratchet-action.

U.S. Pat. No. 3,915,268 discloses a clutch mechanism for effecting rapid disengagement between two shafts that are normally coupled by an unwrap spring, in particular one driven shaft and one drive shaft. The unit is adapted for use with lawn and garden tractor transmissions, and is intended to prevent damage resulting from a sudden halting of the output shaft, from jamming due to abnormal load (i.e. thick grass, etc.). Co-applicant's U.S. Pat. No. 4,433,765 discloses a spring clutch employing multiple springs which are capable of supporting the load between a drive and a driven shaft, and which are arranged to stagger the points at which one spring engages or disengages the drive/driven shafts, so as to reduce the tendency for sudden or step-type motion to occur between the shafts. Multiple embodiments are disclosed; in addition, some of the considerations in the use of springs as clutch control elements are set forth in the specification, namely in cols. 1–3 of the patent.

U.S. Pat. No. 4,751,953 discloses yet another type of spring clutch for a roll-up blind, wherein a wrap spring is utilized between a sprocket or drive member, and a driven member, to enable driving of the latter by the drive member, but to block free-turning of the driven member in the absence of torque applied to the drive member. The operation is briefly set forth in col. 7, lines 2–30.

U.S. Pat. No. 4,779,662 describes still another shade clutch mechanism, incorporating a drive member, a driven member, a stationary core or stud (34), and a wrap spring (62); U.S. Pat. No. 5,167,269 discloses a window shade control mechanism employing a torsion spring for raising the shade, and a clutch spring for controlling the engagement between a pull cord and the shade roller per se. A dwell is incorporated between the movement of the pull cord sprocket and the engagement/disengagement of the clutch, and the arrangement is such that the shade can be drawn by direct pulling on the pull cord; it can be raised by merely a momentary pulling of the pull cord, with the raising torque being supplied by the torsion spring.

Further refinements to spring clutch arrangements are disclosed in U.S. Pat. Nos. 5,058,720; and 5,375,643, respectively. The earlier patent deals with reducing the amount of lost motion which exists between a drive member and a driven member, due to a gap which tends to occur when the control spring of the clutch is first biassed in an unwrapping direction. The second patent is concerned with reducing the effects of undesired loading of the control spring or springs on the bearings, which is accomplished in part by providing multiple springs whose tangs are oriented at equal angular intervals within the clutch so that there is reduced the net effect of the radial bearing loads caused by the spring tangs. The construction is characterized by a reduction in friction and improved resistance against component wear.

As noted above, U.S. Pat. No. 4,433,765 sets forth a number of problems which are inherent in virtually all clutches of the "unwrap" spring type. Among these are the tendency for a spring clutch to suffer from a jerky motion known as "stair-stepping", especially when the clutch is operating in an over-running mode, that is, where the load on the driven member is in the same direction as the force being applied to the drive member. With multiple-turn metal springs, the problem has been found to be especially troublesome, and annoying to the operator.

In addition, the tolerances of the springs are difficult to control, especially in view of various annealing procedures to which they are subjected. Furthermore, plating of the springs is normally required to avoid corrosion, and the added thickness represented by the plating frequently interferes with the transition between binding and sliding-type engagement that is required in order to achieve smooth clutch operation.

Furthermore, spring clutches are prone to damage due to overload, and where no provision is made to protect against this, permanent damage to the clutch can occur, rendering the device inoperative.

Finally, with metal springs there occurs a lack of uniformity from unit to unit, as to both dimension and absolute spring stiffness. The resulting non-uniformities can lead to a situation wherein with a particular "run" of clutches, one or more do not operate satisfactorily, or within the intended design parameters as to load capability, release/operating force, or smoothness of operation.

As a consequence there has been a long felt need for a clutch mechanism which is reliable, yet cost-effective.

SUMMARY OF THE INVENTION

Accordingly, the above disadvantages and drawbacks of prior automatic-locking spring clutches are largely overcome by the present invention, which has for one object the provision of a novel and improved mechanical drive construction which is simple in its structure, and unusually smooth in operation and free of stair-stepping, even when operating in an overrun mode.

A related object of the invention is to provide an improved mechanical drive construction as above set forth, which is constituted of readily moldable components that can be assembled with a minimum of time and effort, and without special tools and the like.

Still another object of the invention is to provide an improved mechanical drive construction in accordance with the foregoing, which is rugged and reliable over extended periods of operation, thereby featuring a long life expectancy.

Yet another object of the invention is to provide an improved mechanical drive construction as above characterized, wherein no reliance is placed on metal springs as control elements, thereby completely eliminating the numerous problems inherent with virtually all prior, metal-spring type clutches.

In accomplishing the above objects the invention provides an automatic-locking mechanical drive construction for raising and lowering a window blind, comprising in combination a fixed cylindrical shaft, a rotary drive member mounted to turn about an axis with respect to said shaft, a rotary driven member turnable with respect to said shaft and about the axis of said drive member, the drive and driven members having pairs of facing, abuttable walls effecting a two-directional, lost-motion rotary driving connection between the members, and a helical coil spring means disposed on and frictionally seizing and locking to the shaft. The spring means is normally temporarily fixed on the shaft, and has a radially-projecting shoulder intermediate its ends. There are provided spaced-apart shoulders on the driven member, individually engageable with the projecting shoulder on the spring means whereby the spring means normally prevents turning of the driven member in either of opposite directions. In addition, lugs are provided on the driving member, respectively engageable with end portions of the spring means to unlock the grip of the latter on the shaft, thereby enabling the abuttable walls of the driven and drive members to engage and turnably drive the driven member in either of two directions as the drive member is turned.

Preferably the spring means is constituted of non-metallic substance, such as nylon/plastic compositions, which react favorably as to frictional engagement with the surface of the fixed cylindrical shaft, as required in control of the driven member by the drive member.

Other features and advantages will hereinafter appear.

BRIEF DESCRIPTION OF THE DRAWINGS

FIG. 7 is a side edge elevational view of the cover piece for the housing of FIGS. 5 and 6.

FIG. 8 is an inside elevational view of the cover piece of FIG. 7.

FIG. 9 is a side elevational view of the spring means of the drive, which serves to effect the locking action thereof.

FIG. 10 is a left end elevation of the spring means.

FIG. 11 is a right end elevation of the spring means.

FIG. 12 is an inside end elevational view of the driven member of the drive.

FIG. 13 is an axial sectional view of the driven member of the drive, taken on the line 13—13 of FIG. 12.

DESCRIPTION OF THE PREFERRED EMBODIMENT

The improved locking drive construction of the present invention is illustrated as being associated with the lowering and raising of window shades, where the shade element is to be locked in any of its raised or lowered adjusted positions, as effected by actuation of a cord passing over a drive pulley. However, the invention has utility in other environments, and it is intended that the structures described herein be not limited to the specific use disclosed.

Basically the present automatic locking drive construction comprises a pair of turnable drive and driven members arranged for abutting direct drive with each other, and comprises a coil-spring type locking means which is acted on by the said members and is cooperable with a stationary base member to lock the driven member thereto as the occasion requires. A housing and mounting means are associated with these components to effect their assembly to each other and securement in the desired environment.

Figure 14:
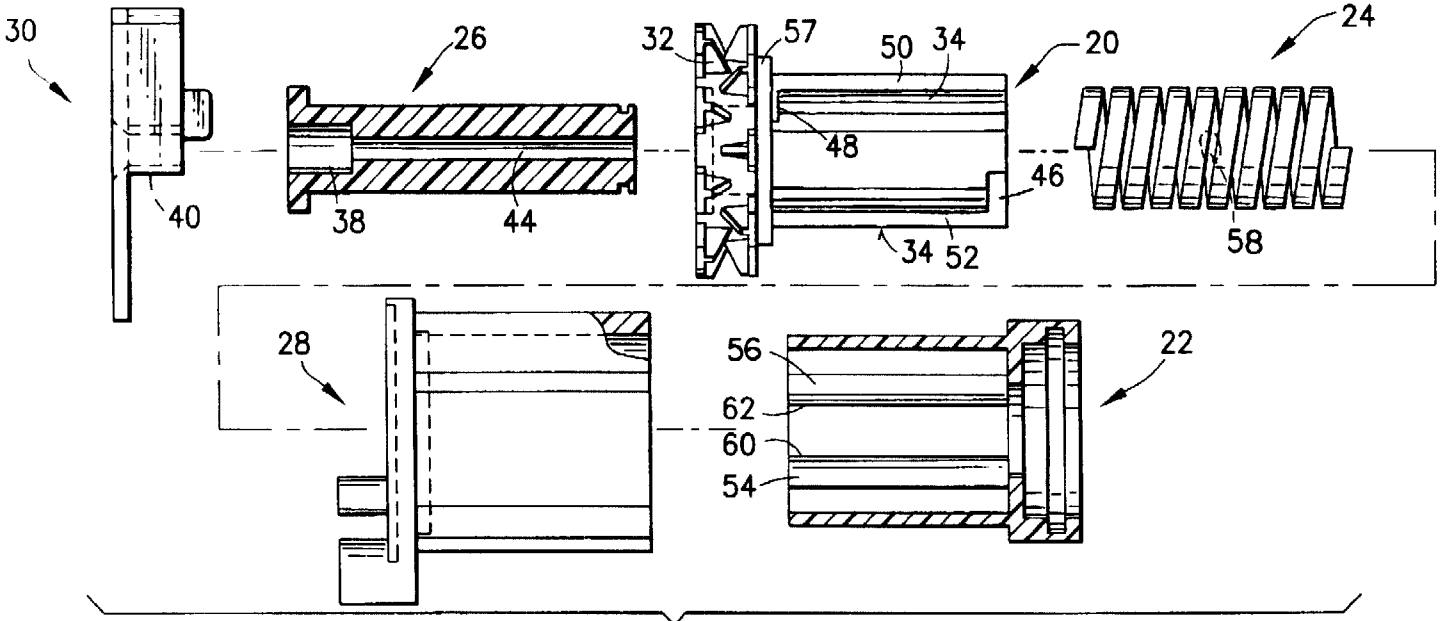
FIG. 14 is an exploded view of most of the various components of the drive, indicating their relationships to each other.

Referring to the exploded view of FIG. 14 of the drawings, the drive member has a semi-cylindrical portion and is designated generally by the numeral 20; the driven member is mostly cylindrical and designated by the numeral 22; the spring means is helical and designated by the numeral 24; the stationary base or anchorage member is a shaft designated by the numeral 26; the housing is identified by the number 28; and a stationary end piece or cover piece for the housing by the numeral 30. All of the above parts are preferably fabricated of various plastic substances which are suited for the uses and stresses which the parts encounter.

Figure 2:
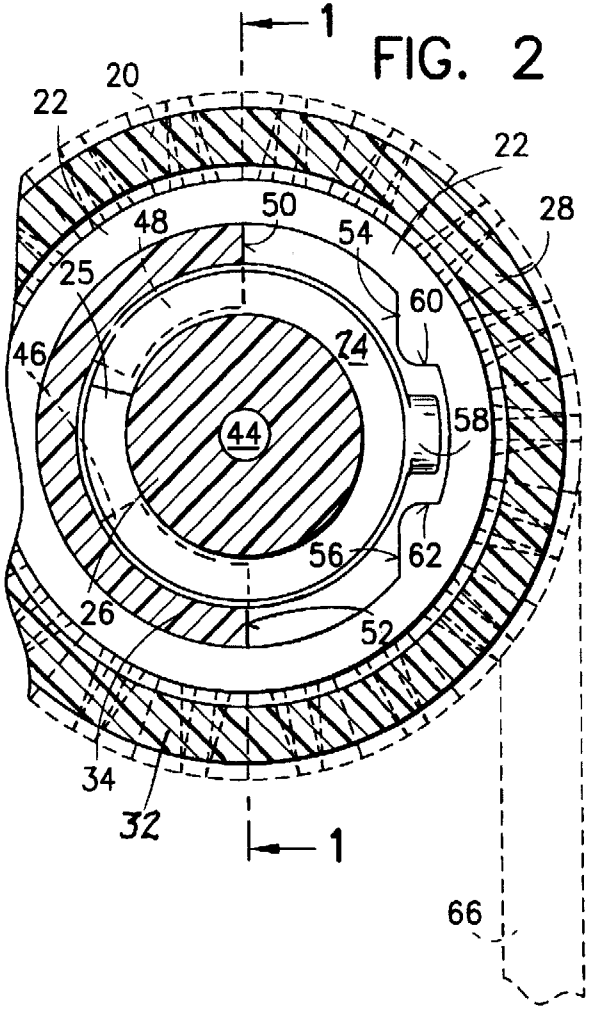
FIG. 2 is a fragmentary sectional view taken on the line 2—2 of FIG. 1, with a drive pulley shown in dotted lines to reveal interior details.
Figure 1:
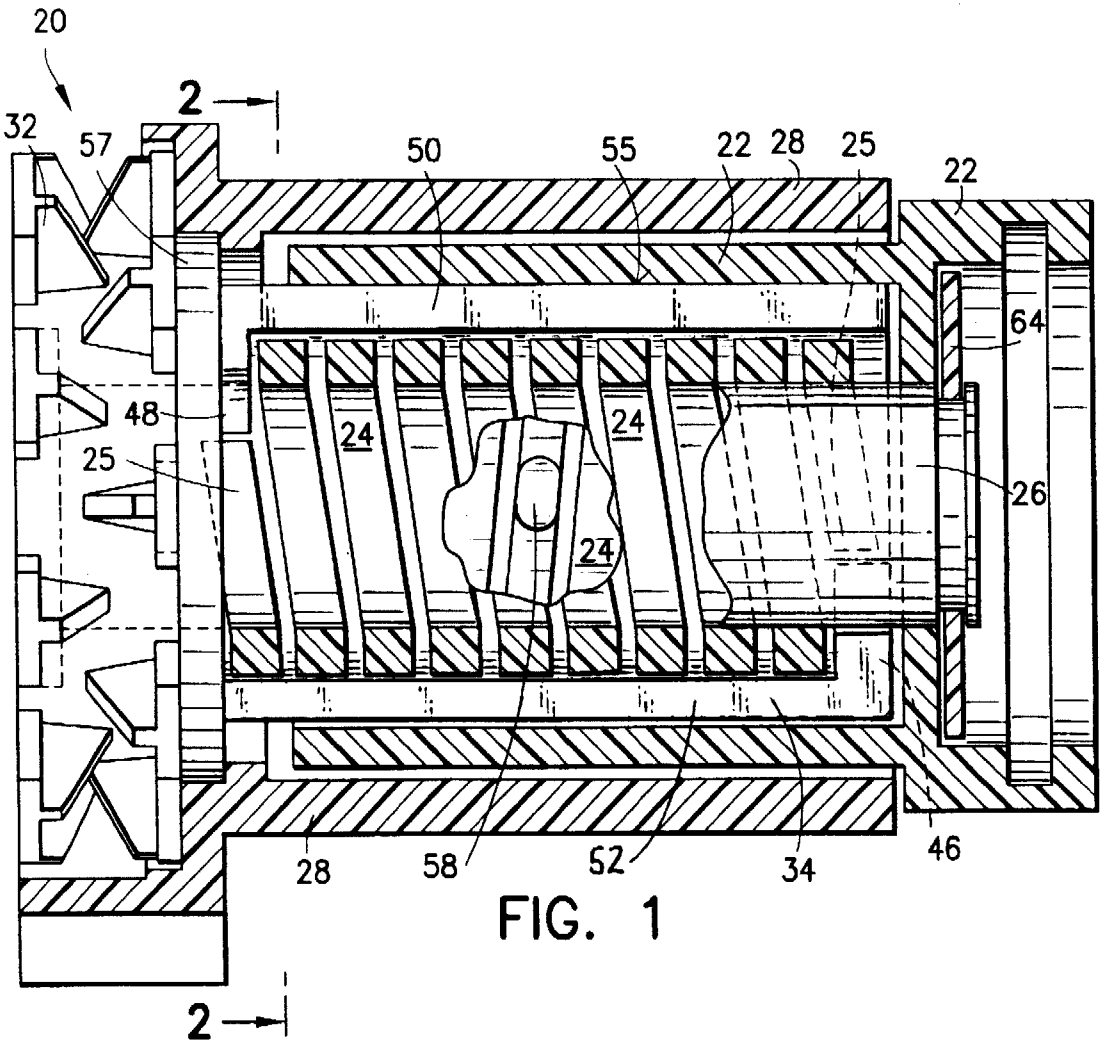
FIG. 1 is an axial sectional view of the locking drive construction as provided by the invention, showing a stationary center shaft, and with an added spring detail. The section is taken on the line 1—1 of FIG. 2.
Figure 4:
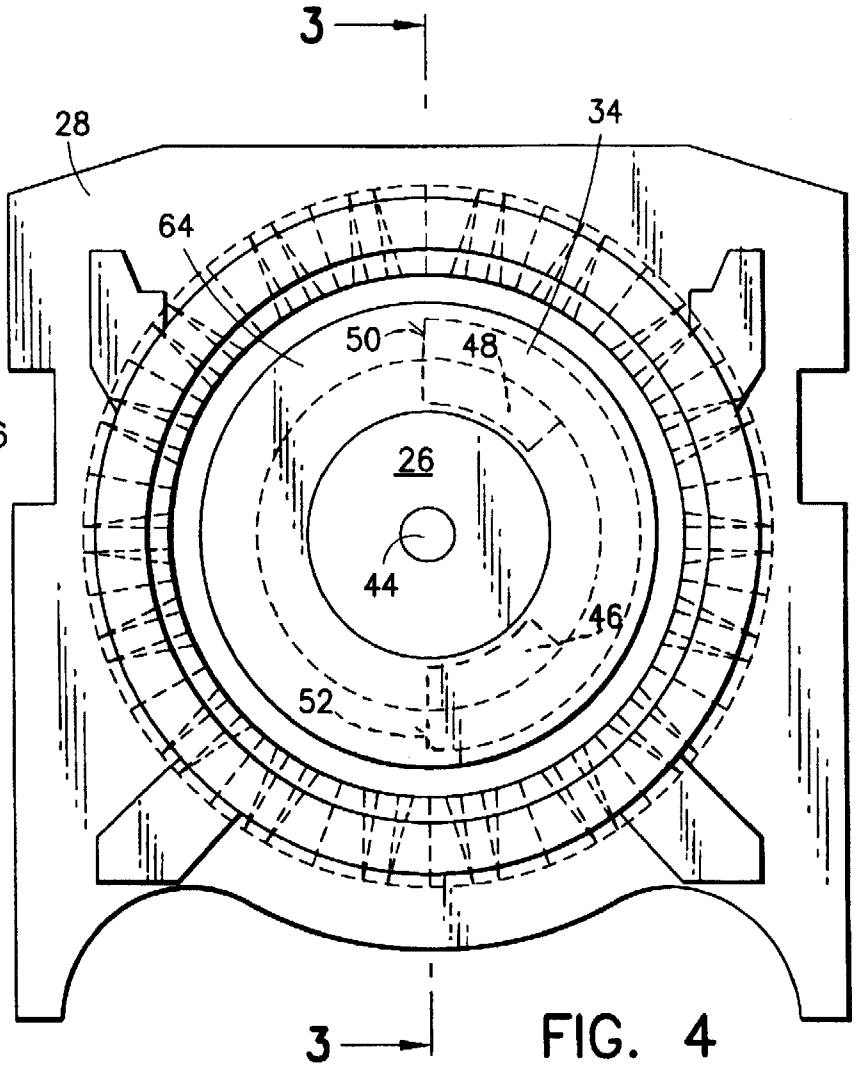
FIG. 4 is a right-end elevational view of the drive construction of FIGS. 1–4 but with the driven member not in place.
Figure 3:
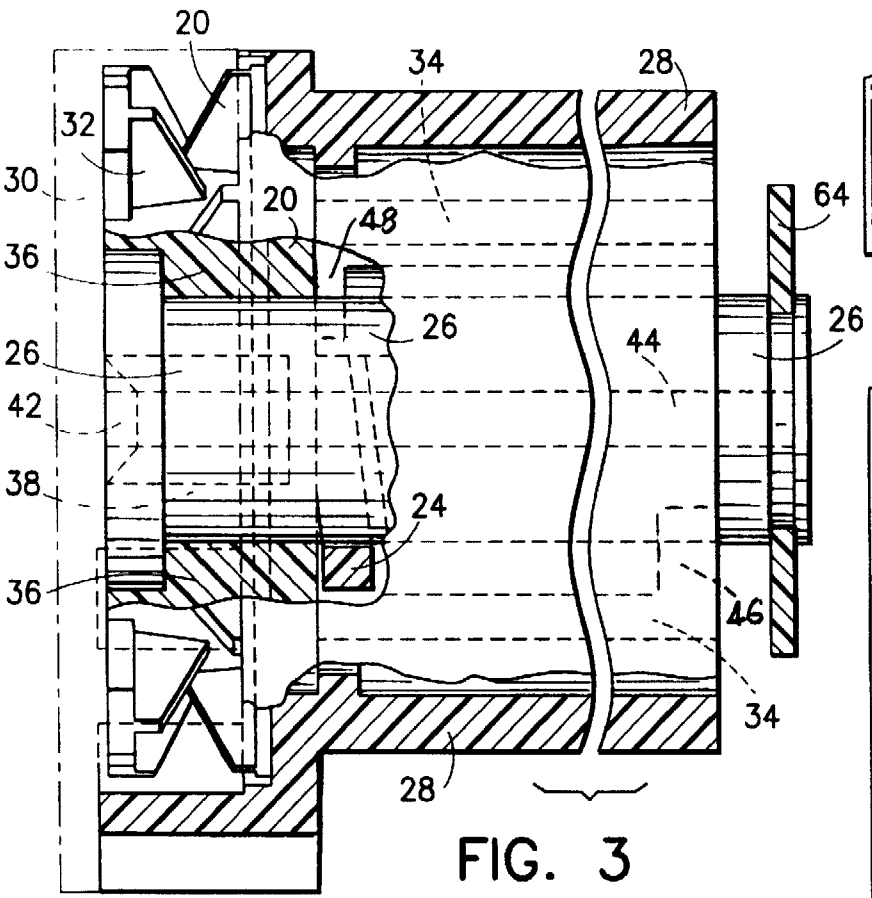
FIG. 3 is an axial sectional view somewhat like that of FIG. 1 but axially compressed, having portions broken away. The section is taken on the line 3—3 of FIG. 4.
Figure 6:
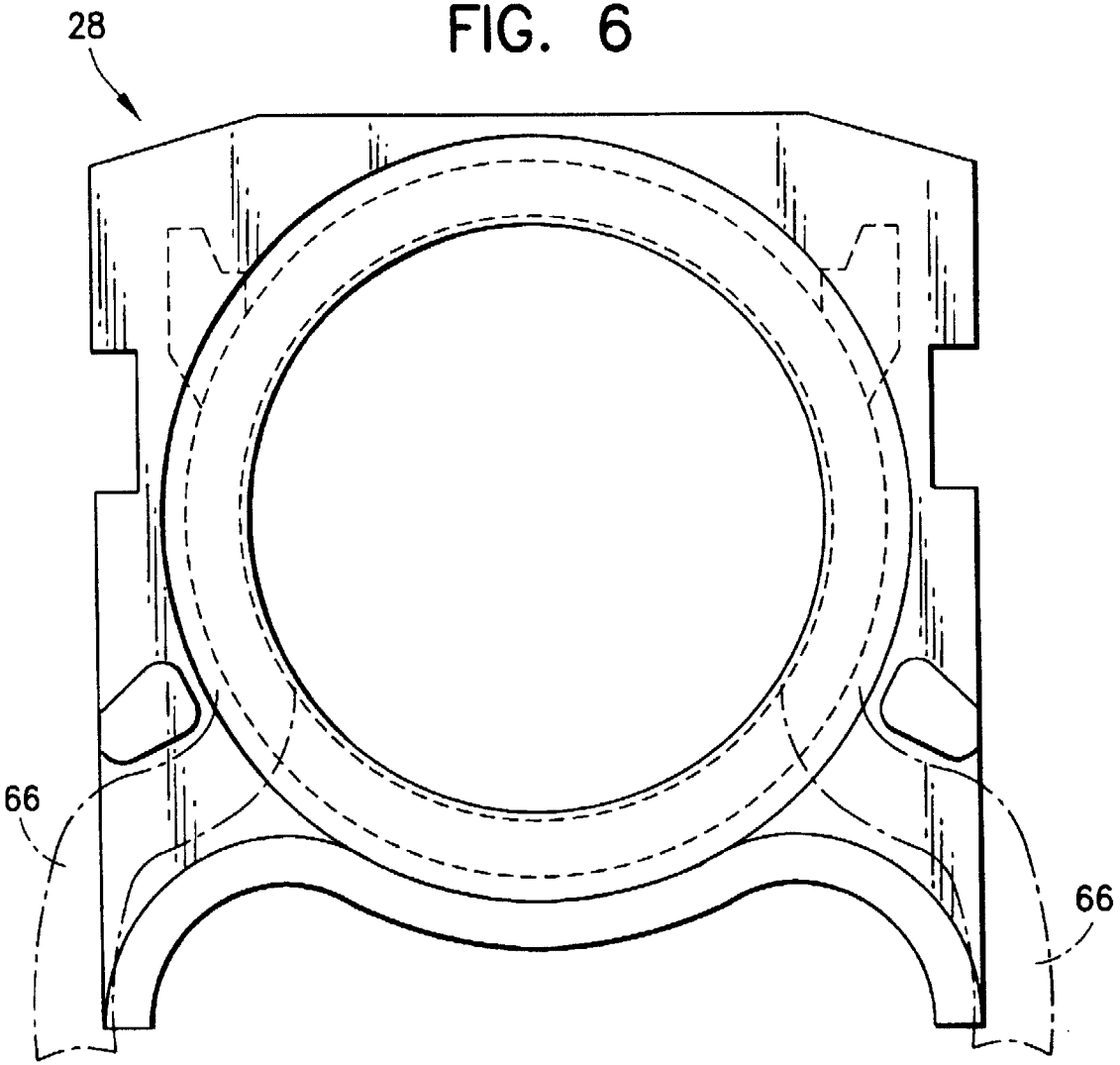
FIG. 6 is an outside face elevational view of the housing member of FIG. 5 with the cover piece not in place.
Figure 5:
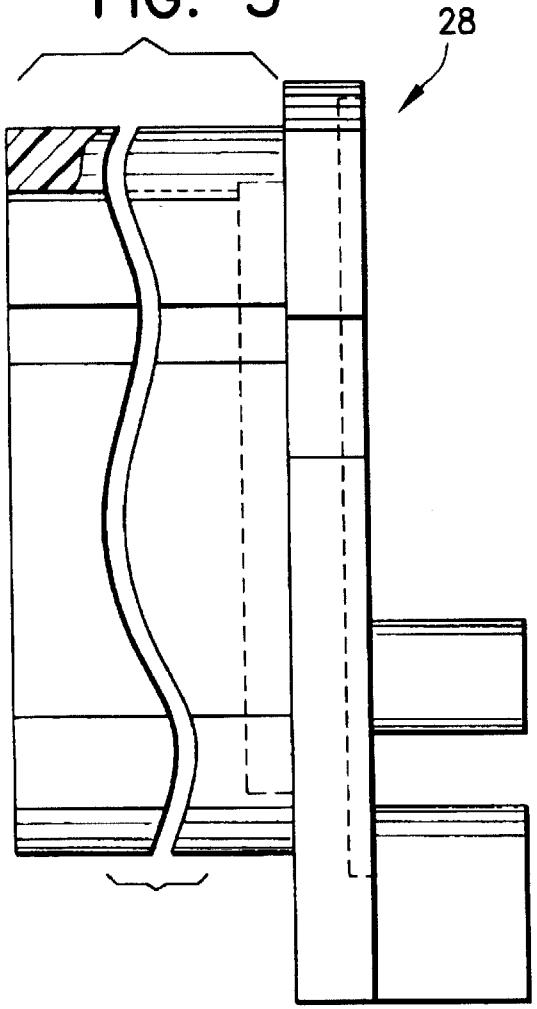
FIG. 5 is a side elevational view, axially compressed, of the housing member per se of the drive construction.

Referring to FIGS. 1 and 2, the drive member 20 comprises a toothed pulley 32 which has attached to its inner side a curved segment or portion 34 in the form of a part of a cylinder, such portion encircling the helical spring means 24. As seen in FIGS. 1 and 2, the spring means 24 closely hugs the stationary shaft 26 of the drive. The pulley 32 is shown dotted in FIG. 2 to reveal interior details of the drive mechanism; it has a hub 36, FIG. 3, which is turnably carried on the shaft 26. In FIG. 14, the shaft 26 has at its outside end, a square socket 38 that receives a square boss 40 of the end cover piece 30 as shown in FIGS. 7 and 8. The boss 40 is bored to receive a fastening screw 42 (FIG. 3) which is threaded into the central bore 44 of the shaft 26 (FIG. 14), such screw stationarily securing the shaft 26 to the stationary end piece 30 and housing 28. By this construction the shaft 26 is mounted in the housing 28 and held against turning.

The helical coil spring 24, while frictionally hugging the shaft 26, is turnable thereon if it is uncoiled to any extent. Without uncoiling of the spring, it acts as a brake due to its frictional seizing of the stationary shaft 26.

In accordance with the present invention and referring to FIGS. 1 and 2, uncoiling of the spring 24 can be effected by means of internal lugs 46 and 48 disposed on the inside of the segment 34 of the drive member 20, which are arranged to abuttingly engage end portions 25 of the spring means 24 as seen in FIG. 1. Thus, turning torque applied to the drive member 20 in either direction will partially uncoil the spring 24 on the shaft 26 and permit such turning to occur.

According to the invention, the segment portion 34 of the drive member 20 has axially extending edge walls 50 and 52 which are respectively abuttable with cooperable walls 54 and 56 (FIG. 2) on the inner cylindrical surface of the driven member 22. Thus, turning of the drive member 20 as permitted by the spring means 24 will result in the member 20 driving the driven member 22 in either direction. The driven member is drivingly connected to the window shade roller (not shown) and this turning movement will thus cause the window shade to be rolled up, or enable it to be drawn (i.e. raised or lowered).

As provided by the present invention the new positions of the window shade will be locked, however, by virtue of the locking action of the spring means 24, in the following manner. The spring means 24 is provided intermediate its ends with a projecting shoulder or nib 58, FIGS. 1 and 2, which is engageable with opposite shoulders 60, 62 on the inner surface of the driven member 22. When torque is applied to the driven member 22 as by the weight of the shade or blind, such engagement locks the member because it results in a tendency for either one or the other of the spring halves or groups to coil up, instead of uncoiling. As is well understood, coiling up of a helical spring on a shaft results in a tighter gripping of the shaft which, in this case, is the stationary or fixed shaft 26. Thus the driven member 22 will be locked insofar as any torque is applied to it. However, torque applied to the driving member 20 first unlocks the spring 24 from the shaft 26, after which continued turning of the drive member will drive the driven member 22, raising or lowering the shade attached to the latter.

In accordance with the invention, the selective action which determines the initial unlocking of the spring 24 results from the lost motion which accompanies the direct drive between the drive and driven members, effected by the spacing of the abuttable walls 50, 54 and 52, 56 respectively from each other, FIG. 2.

The driven member 22 can turnably bear on the outer surface 55 of the segment 34 of the drive member, as shown in FIG. 1. Also shown in this figure is the bearing of the hub 57 of the pulley 32 in the housing 28. As seen in FIG. 2, the driven member turnably bears on the stationary shaft 26 and is secured in place by a spring retainer washer 64. A pull cord 66 passes over the pulley 32 to actuate it in either turning direction.

During the transition between a stationary or locking condition of the driven member and a turning movement thereof, the convolutions of the spring first uncoil to an extent, by the engagement of one of the spring's ends with the internal lugs of the drive member. In the case of movement in what is known as an overrunning-clutch mode of operation, as for example, drawing of the shade wherein the weight of the shade torques the driven member in the same direction as that being applied by the drive member, there arises a tendency for the driven member to run ahead of (or "overrun") the drive member if the drag or frictional force applied to the driven member by the spring is too low, or non-uniform. There results a jerky movement of the shade, known as stair-stepping, where the shade undergoes intermittent "free-fall", namely, drops by a small, finite distance, then halts, then resumes dropping, and so-forth, in the manner of an object going down a flight of stairs. Such a phenomenon has been characteristic of most prior, metal-spring type clutches, and in spite of numerous efforts alleviate the problem of stairstepping, little progress of any consequence has been noted. Prior spring clutches operating in an overrun mode, generally alternately grip and release in spurts, and thus the resulting transition between a lock and an unlock condition leads to the undesired jerky motion characteristic noted above.

In contrast, by the present invention, the tendency for stair-stepping to occur is greatly reduced by virtue of the plastic composition of the spring and the shaft or member which engages the spring, under transitions between a lock condition and a moving condition. In addition, as presently understood and with the disclosed arrangement, that group of spring convolutions on the one side of the nib which is opposite to the spring end that is engaged by the drive member, during drawing of the shade, serves as a constant friction drag on the driven member. This drag has been found to be sufficient to interrupt or circumvent the above-noted "drop, halt, drop" sequence referred to above, as stair-stepping. The convolutions which effect the drag can be thought of as "stabilizers" or "stabilizing convolutions", in that they effect a smoothness of movement heretofore unattainable with prior clutches.

Also, as presently understood, the smooth operation provided by the plastic spring is considered to be unique to plastic composition components, and the results obtained believed to be most difficult to achieve with any arrangement involving metal springs, due to the relatively greater elasticity of plastic (i.e. greater stiffness of metal), and the inability to mass-produce metal springs having acceptable unit-to-unit uniformity. Such uniformity is, on the other hand, readily obtainable with molded plastic springs, and accordingly, superior results have been observed in clutch constructions of the type set forth in the present application.

Furthermore, increased flexibility is realizeable with plastic springs, due to the ability to incorporate in the plastic substance, specific chemical additives that can beneficially affect the plastic's physical characteristics, such as stiffness, fatigue strength, wear, stretch and compression coefficients, etc., as well as lubricity. The same is true of the shaft on which the spring is wrapped, which is also constituted of plastic and which can contain additives, as necessary, to alter its slide/grip characteristics. Thus, the physical characteristics of the components can be selected to constitute a more or less continuously adjustable function of the chemical compositions of which the components are fabricated. Moreover, with the present arrangement, both the springs and the shafts can be customized to suit a particular application, as to load, dimension, torque requirements, and so forth. Metal springs are considered to lack this design flexibility.

Figure 17:
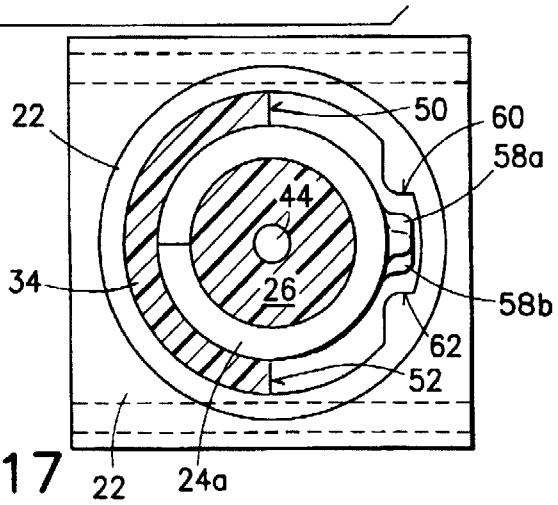
FIG. 17 is a partial sectional view similar to the view of FIG. 2 of the drive construction but incorporating the modified spring of FIGS. 15 and 16.
Figure 15:
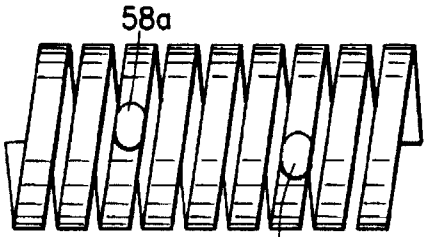
FIG. 15 is a side elevational view of a modified helical coil spring construction for alternative use in the drive construction of FIGS. 1–14.
Figure 16:
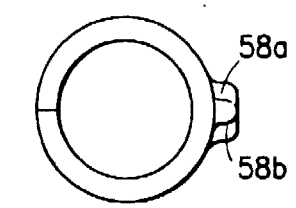
FIG. 16 is a left end elevational view of the spring of FIG. 15.

FIGS. 15–17 illustrate a modification of the invention, embodying a different helical locking spring means **24*a* which has two, spaced-apart nibs 58*a* and 58*b*, each disposed several convolutions away from the respective spring ends, as distinguished from the single nib 58 shown in the previous figures. The spring 24*a* is shown in FIG. 17 embodied on the stationary shaft 26, with the nibs 58*a* and 58*b* disposed between the opposite shoulders 60 and 62 of the driven member 22. As viewed in FIG. 17, the nibs 58*a* and 58*b* have the effect of being staggered between the shoulders 60 and 62, reducing the effective clearance space and reducing the movement required of the driven member 22 to start the locking action. Also, the locking action will now involve a greater number of convolutions of the spring 24*a***, regardless of the direction of the torque applied to the driven member.

All parts of the present improved drive construction can be economically molded of plastic substance. We have found that special and advantageous reduced-friction gripping properties can be had between the shaft 26 and the helical spring 24 when these are both fabricated of plastic substance, and this is an important feature of the invention. The spring means 24 can be economically molded in plastic, and will not rust or require heat treatment, platings, or the like. The rust-resistant construction thereby enables the shade (and clutch mechanism) to be periodically cleaned or washed with a water-based cleaning solution, which was not heretofore possible with metal spring structures.

An overall superior product is thus realizeable with the present invention.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

Listing of Numerals

20. Rotary Drive Member

22. Rotary Cylindrical Driven Member

24. Spring Means
24*a*. Modified Spring Means
25. Contact Ends of Spring Means
26. Fixed Center Shaft
28. Housing
30. Cover Piece
32. Pulley or Sprocket
34. Segment of Drive Member
36. Hub of Sprocket
38. Square Socket in Shaft 26
40. Boss in Cover Piece 30
42. Fastening Screw
44. Central Bore in Shaft 26
46. Lug in Drive Member
48. Lug in Drive Member
50. Abuttable Edge Wall on Drive Member
52. Abuttable Edge Wall on Drive Member
54. Cooperable Abuttable Wall on Driven Member
55. Outer Surface of Segment 34
56. Cooperable Abuttable Wall on Driven Member
57. Hub or Bearing Shoulder
58. Projecting Shoulder or Nib on Spring Means 24
58*a*. Modified Nib on Spring Means 24*a*
58*b*. Modified Nib on Spring Means 24*a*
60. Opposite Shoulder on Driven Member
62. Opposite Shoulder on Driven Member
64. Spring Retainer Washer or Clip
66. Pull Cord

What is claimed is:

1. An automatic-locking mechanical drive construction for raising and lowering a window blind, comprising in combination:

a) a fixed cylindrical shaft, b) a rotary drive member mounted to rotate about an axis with respect to said shaft, c) a rotary driven member turnable with respect to said shaft and about the axis of said drive member, d) said drive and driven members having pairs of facing, abuttable walls effecting a two-directional, lost-motion rotary driving connection between the members, e) helical coil spring means on and frictionally seizing and locking to said shaft, said spring means being thereby normally temporarily fixed on the shaft, f) said spring means having a radially-projecting shoulder intermediate its ends, g) spaced-apart shoulders on the driven member, individually engageable with said projecting shoulder on the spring means whereby said spring means normally prevents turning of the driven member in either of opposite directions, and h) lugs on said drive member, respectively engageable with end portions of the spring means to unlock the grip of the latter on the shaft, thereby enabling the abuttable walls of the driven and drive members to turnably drive the driven member in either of two directions as the drive member is turned in said directions.

2. A drive construction as set forth in claim 1, wherein:

a) said spring means is constituted of plastic substance.

3. A drive construction as set forth in claim 2, wherein:

a) said spring means comprises a glass-filled polyamide plastic.

4. A drive construction as set forth in claim 2, wherein:

a) said spring means has a rectangular cross section.

5. A drive construction as set forth in claim 1, wherein:

a) said radially-projecting shoulder of the spring means is midway of the spring ends.

6. A drive construction as set forth in claim 2, wherein:

a) the ends of said spring means are of square-cut configuration.

7. A drive construction as set forth in claim 1, wherein:

a) the drive member comprises a circular segment of a cylinder, which encircles portions of the convolutions of said spring means.

8. A drive construction as set forth in claim 7, wherein:

a) said circular segment of the drive member encircles substantially one-half of the circumference of said spring means.

9. A drive construction as set forth in claim 7, wherein:

a) the abuttable walls of the drive member are on the circular segment thereof.

10. A drive construction as set forth in claim 7, wherein:

a) the driven member comprises a cylinder.

11. A drive construction as set forth in claim 10, wherein:

a) the shoulders of the driven member are on the inner circumference of the cylinder.

12. A drive construction as set forth in claim 11, wherein:

a) the abuttable walls of the driven member are on the inner circumference of the cylinder and straddle the shoulders of the cylinder.

13. A drive construction as set forth in claim 1, wherein:

a) the drive and driven members have a telescopic fit.

14. A drive construction as set forth in claim 13, wherein:

a) the fixed shaft is centralized in the drive and driven members.

15. A locking drive construction as set forth in claim 1, and further including:

a) an additional projecting shoulder on the spring means, disposed intermediate the ends of the latter, b) said additional shoulder being axially displaced from said first-mentioned shoulder, c) said spaced-apart shoulders on the driven member individually and selectively engaging the shoulders of the spring means according to the direction of the torque applied to the driven member.

16. A locking drive construction as set forth in claim 1, and further including:

a) an additional projecting shoulder on the spring means, disposed intermediate the ends of the latter, b) said additional shoulder being axially displaced from said first-mentioned shoulder and being circumferentially misaligned therefrom whereby the spaced-apart shoulders on the driven member individually and selectively engage the shoulders of the spring means according to the direction of the torque applied to the driven member.

17. A drive construction as set forth in claim 1, wherein:

a) said spring means is constituted of plastic substance, b) said shaft comprising plastic substance, c) the friction between the shaft and spring means being a function of the plastic compositions thereof.

18. A drive construction as set forth in claim 17, wherein the plastic substance of the spring means and/or the shaft includes additives which modify the physical characteristics thereof.

19. An automatic-locking mechanical drive construction for raising and lowering a window blind, comprising in combination:

a) a fixed cylindrical member, b) a rotary drive member mounted to rotate about an axis with respect to said cylindrical member, c) a rotary driven member turnable with respect to said cylindrical member and about the axis of said drive member, d) said drive and driven members having pairs of facing, abuttable walls effecting a two-directional, lost-motion rotary driving connection between the drive and driven members, e) helical coil spring means engaging and frictionally seizing and locking to said cylindrical member, said spring means being thereby normally temporarily fixed with respect to the cylindrical member, f) said spring means having a radially-extending shoulder intermediate its ends, g) spaced-apart shoulders on the driven member, individually engageable with said radially-extending shoulder on the spring means whereby said spring means normally prevents turning of the driven member in either of opposite directions, and h) lugs on said drive member, respectively engageable with end portions of the spring means to unlock the grip of the latter on the cylindrical member, thereby enabling the abuttable walls of the driven and drive members to turnably drive the driven member in either of two directions as the drive member is turned in said directions.

20. An automatic-locking mechanical drive construction for raising and lowering a window blind, comprising in combination:

a) a fixed cylindrical shaft, b) a rotary drive member mounted to rotate about an axis with respect to said shaft, c) a rotary driven member turnable with respect to said shaft and about the axis of said drive member, d) said drive and driven members having pairs of facing, abuttable walls effecting a two-directional, lost-motion rotary driving connection between the members, e) helical coil spring means on and frictionally seizing and locking to said shaft with its convolutions, said spring means being thereby normally temporarily fixed on the shaft, f) said spring means having a radially-projecting shoulder intermediate its ends, dividing the convolutions into two groups, g) spaced-apart shoulders on the driven member, individually engageable with said projecting shoulder on the spring means whereby one group or the other of the convolutions of said spring means normally prevents turning of the driven member in one direction or the other of opposite rotary directions, said group which does not prevent turning constituting a frictional drag on the driven member to thereby prevent stair-stepping of the latter as it is being driven, and h) lugs on said drive member, respectively engageable with end portions of the spring means to unlock the grip of the latter on the shaft, thereby enabling the abuttable walls of the driven and drive members to turnably drive the driven member in either of two directions as the drive member is turned in said directions.

* * * * *